US009583281B2

(12) United States Patent
Von Allmen et al.

(10) Patent No.: US 9,583,281 B2
(45) Date of Patent: Feb. 28, 2017

(54) CONTROL OF SPRING(S) TYPE FOR A HIGH- OR MEDIUM-VOLTAGE BREAKER FURNISHED WITH A PAWLED FREE WHEEL COUPLING DEVICE

(71) Applicant: Alstom Technology Ltd., Baden (CH)

(72) Inventors: Peter Von Allmen, Buchs (CH); Roger Boiteux, Oberentfelden (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 194 days.

(21) Appl. No.: 14/396,920

(22) PCT Filed: Apr. 23, 2013

(86) PCT No.: PCT/EP2013/058343
§ 371 (c)(1),
(2) Date: Oct. 24, 2014

(87) PCT Pub. No.: WO2013/160272
PCT Pub. Date: Oct. 31, 2013

(65) Prior Publication Data

US 2015/0107973 A1 Apr. 23, 2015

(30) Foreign Application Priority Data

Apr. 25, 2012 (FR) ..... 12 53785

(51) Int. Cl.
*H01H 3/58* (2006.01)
*H01H 3/30* (2006.01)

(52) U.S. Cl.
CPC ... *H01H 3/3021* (2013.01); *H01H 2003/3084* (2013.01); *H01H 2235/016* (2013.01); *Y10T 74/19874* (2015.01)

(58) Field of Classification Search
CPC ..... Y10T 74/19874; Y10T 74/19642; Y10T 74/19647; H01H 3/3021; H01H 2003/3063; H01H 2043/107; H01H 3/30
(Continued)

(56) References Cited

U.S. PATENT DOCUMENTS 3,183,332 A 5/1965 Frink
4,491,709 A 1/1985 Chabot
(Continued)

FOREIGN PATENT DOCUMENTS

CN 1471117 A 1/2004
DE 3320242 A1 12/1984
(Continued)

OTHER PUBLICATIONS

International Search Report issued is Application No. PCT/EP2013/058343 dated Jul. 10, 2013.
(Continued)

*Primary Examiner* — Renee Luebke
*Assistant Examiner* — Ahmed Saeed
(74) *Attorney, Agent, or Firm* — Pearne & Gordon LLP

(57) ABSTRACT

The invention relates to a spring controller for high- or medium-voltage electric switchgear, the controller having a free-wheel coupling device between a crank handle or a motor and the drive shaft (1) for driving a switch contact of the switchgear and respectively providing coupling while the spring(s) (11) is/are being loaded and decoupling while the spring(s) is/are being released. The free-wheel mechanical device is incorporated in a toothed wheel (2) of the controller and includes at least one pawl (7, 70) meshing or not meshing with an inner set of teeth (4) of the toothed wheel (2).

8 Claims, 5 Drawing Sheets

(58) Field of Classification Search
USPC ..... 200/335, 400, 501; 74/412 R, 413, 435
See application file for complete search history.

(56) References Cited

U.S. PATENT DOCUMENTS

| | | | | |
|---|---|---|---|---|
| 4,498,788 | A | 2/1985 | Grimmer | |
| 5,723,836 | A * | 3/1998 | Okuno | H01H 3/30 200/501 |
| 6,967,302 | B2 | 11/2005 | Peter | |
| 7,671,292 | B2 * | 3/2010 | Suter | H01H 3/3026 200/400 |
| 2004/0003989 | A1 | 1/2004 | Allmen | |
| 2004/0104106 | A1 | 6/2004 | Peter | |
| 2011/0226074 | A1 | 9/2011 | Engemann | |
| 2015/0103459 | A1 | 4/2015 | Von Allmen | |
| 2015/0108092 | A1 | 4/2015 | Von Allmen | |

FOREIGN PATENT DOCUMENTS

| | | | |
|---|---|---|---|
| DE | 19503679 | C1 | 6/1996 |
| DE | 10 2010 011 997 | A1 | 9/2011 |
| EP | 1408522 | A1 | 4/2004 |
| WO | 2008/117437 | A1 | 10/2008 |
| WO | 2009/056373 | A1 | 5/2009 |
| WO | 2009/144297 | A1 | 12/2009 |

OTHER PUBLICATIONS

French Search Report issued in corresponding application No. FR 12 53785 dated Jan. 2, 2013.
Office Action issued in corresponding Chinese Patent Application No. 201380030456.6 dated Feb. 14, 2016.

* cited by examiner

CONTROL OF SPRING(S) TYPE FOR A HIGH- OR MEDIUM-VOLTAGE BREAKER FURNISHED WITH A PAWLED FREE WHEEL COUPLING DEVICE

TECHNICAL FIELD

The invention relates to an actuator, also referred to as a controller, of the type in which energy is stored in one or more springs, commonly referred to as a spring controller, for use with a switch having a free-wheel coupling device.

The invention applies more particularly to high- or medium-voltage switches and more particularly to high- or medium-voltage circuit breakers, either for those used in gas insulated substations (GIS) or those used with air insulation, commonly referred to in English as "dead-tank" or "live-tank" devices.

PRIOR ART

Free-wheel coupling devices are already known in the prior art, in particular those having a ratchet that consist, in general terms, in a ratchet wheel having teeth that are inclined in such a manner that in one direction the teeth lift at least one pawl that is mounted on a driven member, which can thus continue to turn freely, while in the other direction the wheel abuts against the pawl(s) and is thus coupled in rotation with the driven member.

By way of example, mention may be made of patent application DE 3 320 242, which discloses such a ratchet free-wheel coupling device for a timer. In that application, at the rotary torque under consideration, the ratchet wheel 3 drives a ring 1 in one direction G, which ring 1 is arranged coaxially around the wheel, and does not drive the ring 1 in the other direction V, i.e. the ratchet wheel 3 operates as a free-wheel. More precisely, the ratchet wheel 3 has a central portion with three identical flexible arms 4, 5, 6 connected thereto that are arranged symmetrically thereabout. Each end of an arm 4, 5, 6 is provided with a finger 7, 8, 9 in the form of a pointed tooth 13, 14 that is asymmetrical relative to the radius of the wheel 3. A pawl is thus formed by the combination of an arm 4, 5, 6 and its corresponding finger 7, 8, 9. The asymmetry of each finger 13, 14 in the form of a pointed tooth is such that one of its flanks 13 is parallel to an edge 2' of each tooth 2 of the outer ring 1, while the other flank 14 is inclined at an angle relative to the edge 2" of each tooth 2 of the ring 1. Thus, the parallel alignment of the flank 13 with the tooth edge 2' prevents any relative movement between them in the direction of rotation G of the wheel 3 at the intended level of rotary torque. In contrast, the angle of inclination between the flank 14 and the tooth edge 2" enables them to move relative to each other in the direction of rotation V of the wheel 3, i.e. makes free-wheel operation possible. As mentioned in the patent itself, it is always possible to envisage free-wheel operation of the ratchet wheel 3 in the direction G, providing a rotary torque of much greater value is applied thereto. Thus, it is not possible to envisage using the ratchet free-wheel coupling device of that patent DE 3 320 242 in a high-voltage circuit breaker spring controller because doing so would amount to releasing the spring(s) in uncontrolled manner, so that it would no longer be possible to load it/them once more. In other words, it is not possible to envisage applying the ratchet free-wheel coupling device of patent DE 3 320 242 in a high-voltage circuit breaker spring controller.

The prior art also includes spring type controllers for high-voltage electric switches, such as circuit breakers, that include a free-wheel coupling device.

High- or medium-voltage switch controllers of the spring type generally have a hand- or motor-driven crank that enables an opening or closing spring to be loaded via a geartrain so that on being released the spring enables at least one movable contact to be moved towards or away from the other contact, thereby opening or closing the switch. In other words, the spring is arranged in the controller so that releasing the elastic energy it has stored causes the contacts of the switch to open or close.

The free-wheel coupling device is thus designed to couple a drive wheel of the geartrain with the crank handle or the motor in such a manner that the wheel reaches the geared-down speed of rotation of the motor or the handle. When loading the spring, the crank handle or the motor drives the drive wheel to the top dead-center of the spring.

By way of example, when the spring is for closing the switch, the spring drives the furthest-downstream drive element at a speed that is much faster than the speed obtained by drive from the motor or the handle. During such closure of the switch by the closure spring, the handle or the motor is decoupled from the geartrain by the free-wheel coupling device in order firstly to provide the motor, when the motor is used, and the gear with mechanical protection, and secondly to reduce the inertia of the elements driven by the spring. The high accelerations and speeds implemented by means of the geartrain during closing run the risk of causing premature wear of at least some parts of the motor and the gearing. Under both circumstances (while loading the closure spring and while performing the closure operation), the direction of rotation of the furthest-downstream drive element is the same. This makes it possible to recover return energy from the system in the closure spring. Recovering energy reduces the time required to set the spring and reduces the amount of energy that needs to be delivered by the motor (crank handle). During a closure operation, after the furthest-downstream drive element has reached a specific angle of rotation, it is possible to switch on the motor. During a first stage, the furthest-downstream drive element has a speed of rotation that is faster than when it is controlled by the motor, the free-wheel coupling device is decoupled, and the furthest-downstream drive element and the motor rotate freely. During a second stage, when sufficient energy has been recovered by return to the closure spring, the drive element has slowed down to a speed of rotation that is slower than when it is controlled by the motor. However, during this second stage, the free-wheel coupling device becomes coupled and the motor controls the drive wheel in order to reset the closure spring fully.

In other words, free-wheel coupling devices are used in the spring controllers of high- or medium-voltage electric circuit breakers in order to enable the spring(s) to be released for opening or closing the contacts of the circuit breaker without any rotary torque being applied to the crank handle or to the motor. Those free-wheel coupling devices are thus essential, firstly for reasons of safety: under no circumstances should an operator be injured by untimely and uncontrolled rotation of a crank handle. Furthermore, without using such free-wheel coupling devices, any opening and closing of the contacts of the circuit breaker might be delayed by the rotary inertia of the crank handle and/or of the motor while the spring is relaxing.

Document DE 195 03 679 discloses a spring controller for a high-voltage circuit breaker in which a free-wheel bearing is arranged between the last toothed wheel of loading gearing, and the gearwheel that is connected to the drive wheel that is coupled to the closure spring as loaded in this way. Torque is transmitted solely from the gearing towards the closure spring. The type of free-wheel bearing is not specified.

Document EP 1 408 522 discloses a spring controller for a high-voltage circuit breaker that includes a free-wheel coupling device consisting in a cone clutch. By means of the cone clutch, torque is transmitted from a drive shaft to a rotary shaft in a predetermined direction of rotary movement between the two shafts, and there is free-wheel operation of the rotary shaft in the opposite direction of rotary movement between the two shafts.

Those spring controllers for switches that include existing free-wheel coupling devices are not entirely satisfactory: they may thus be designed to have a large number of parts and thus a significant cost and/or complicated control over friction parameters.

Application WO 2008/117437 discloses a spring controller for high-voltage switchgear having a motor 3 for loading a closure spring 22 (helical compression spring) to which it is coupled via a set of three wheels, i.e. an outlet toothed wheel 16 of the motor, an intermediate toothed wheel 33, 43 meshing permanently with the outlet wheel 16, and a primary toothed wheel 5 arranged coaxially with the drive shaft 1 of the movable contact of the switch and incorporating a free-wheel coupling device enabling it to be decoupled from the intermediate wheel 33, 43, as explained below. More exactly, and as shown better in FIG. 3, the primary wheel has a set of three gearwheels A, B, C arranged side by side on the same axis as the drive shaft 1 of the movable contact of the switch, wherein the middle gearwheel B is provided with teeth over its entire outer periphery, while the two end gearwheels A and C are lacking teeth over a circular peripheral zone respectively referenced 34a or 34b, while the remainder of their outer peripheries are provided with teeth. The end gearwheel C arranged closest to the switch is provided on its inner periphery with two pawls 41a and 41b that are arranged diametrically opposite each other and that are mounted to move in translation along the diameter of the gearwheel C. These pawls are of a shape that is complementary to that of the sloping teeth formed over the entire inner periphery 36 of the middle gearwheel A. The closure spring 22 is fastened directly to the gearwheel A via a peg 7 and an arm 8 forming an arm for compressing the spring 22.

The operation of the controller with its free-wheel coupling device as disclosed in that application WO 2008/117437 is as follows: in order to load (compress) the closure spring 22, the motor 3 is switched on and rotates its outlet toothed wheel 16 in the clockwise direction. The permanently meshing intermediate toothed wheel 33 is then driven counterclockwise and simultaneously the primary toothed wheel 5 is driven clockwise, with the directions clockwise and counterclockwise being defined relative to the face view shown in the figures of the patent application. When the closure spring 22 is fully loaded, i.e. when it has reached its top dead-center, the peripheral zone of the gearwheel A that has come level with the meshing portion 43 of the intermediate wheel is the circular zone 34 without teeth. Thus, in this position of rotation, the intermediate wheel 33 meshing permanently with the outlet wheel 16 of the motor 3 continues to rotate without driving the gearwheel A. In other words, the toothless circular zone 34 of the gearwheel A provides decoupling between the motor 3 and the gearwheel A that is itself secured to the closure spring 22, thereby preventing any damage to the motor 3 in the event of a sudden stop. The same applies with the gearwheel C in which the toothless circular zone 34b facing the toothless circular zone 34a of the gearwheel A likewise enables decoupling with the motor 3. In contrast, because it has teeth over its entire outer periphery, the gearwheel B continues to rotate. While loading the closure spring 22, the two pawls 41a, 41b of the gearwheel C are engaged in the inner teeth 36 of the gearwheel B. Consequently, the gearwheel B turns simultaneously with the gearwheel C in the clockwise direction. During release of the closure spring 22 for closing the switch of the high-voltage switchgear, the gearwheels A and C turn simultaneously in the clockwise direction, the pawls 41a and 41b of the gearwheel B being engaged in the teeth 36 of the gearwheel B and thus serving to couple all three gearwheels A, B, C together once more in rotation.

The major drawback of the closure spring controller according to that application WO 2008/117437 is that the closure operation is slowed down by the inertia of the rotary parts, i.e. the gearwheels A, B, C with the pawls 41a and 41b and the intermediate wheel 33, and also the motor. In addition, the coupling device disclosed in that application WO 2008/117437 cannot be incorporated in a controller that is loaded by means of a crank handle, since given that the inlet wheel 16 is driven permanently, there would necessarily be a risk of driving the crank handle.

U.S. Pat. No. 4,491,709 discloses a spring controller for use in a circuit breaker for a short-circuit current of 85 kiloamps (kA) at 600 volts (V) or of 100 kA to 150 kA at 480 V. The spring controller of that patent serves to load a closure spring 70 (helical compression spring) either via an actuator handle 98 or via a motor 180, the release of the spring enabling the movable contact 26 to be closed against the stationary contact of the circuit breaker. That controller includes a ratchet assembly 178 including an annular ratchet wheel 188 having teeth 190 over its entire outer periphery and teeth 194 over its entire inner periphery. That controller also has two completely distinct control mechanisms, the first of which has the actuator handle 98 for manually controlling rotation of the ratchet wheel 188, and the second of which includes the motor 180 for controlling rotation of the ratchet wheel 188. The first mechanism includes firstly a stop pawl (anti-return pawl) 201 that is mounted close to the periphery of the ratchet wheel 188 and that serves to prevent it from turning in the clockwise direction. A pull link 182 is connected to another link 186 and is capable of actuating another pawl 192 in thrust, which other pawl is likewise mounted at the peripheral proximity of the ratchet wheel 188. Actuating that other pawl 192 enables the ratchet wheel 188 to be rotated in a counterclockwise direction in the face view of FIG. 4G, when the link 186 is operated manually. By means of the anti-return pawl 201, the ratchet wheel 188 cannot apply a rotary moment to the link 186. As shown in FIG. 4J of that U.S. Pat. No. 4,491,709, the second mechanism has three pawls 202 mounted at 120° relative to one another on the shaft 166 and meshing with the teeth 194 at the inner periphery of the ratchet wheel 188. A gearwheel 206 is mounted stationary on the shaft 166, which gearwheel is connected to a motor 180 by means of another gearwheel 210. Thus, the drive gearwheel 206 drives the three pawls 202 in rotation in a counterclockwise direction in the face view of FIG. 4J, in such a manner that they engage in the teeth 194 on the inner periphery of the ratchet wheel 188. Because of the way the pawl 192 is mounted, rotary drive of the ratchet wheel 188 enables the three pawls 202 to be rotated in the counterclockwise direction (FIG. 4J) but does not actuate said pawl 192. In other words, in this counterclockwise direction as seen in the face view of FIG. 4J, the pawl 192 is not in meshing engagement with the teeth 190 at the outer periphery of the ratchet wheel 188, while the three pawls 202 are engaged with the teeth 194 on the inner periphery of the ratchet wheel 188, thereby enabling it to be rotated. In still other words, the three pawls 202 driven in rotation by the motor 180 for rotating the ratchet wheel 188 do not give rise to driving torque on the pawl 192 and thus on the link 186 connected to the actuator handle 98. The major drawback of the controller of U.S. Pat. No. 4,491,709 is its mechanical complexity with two distinct mechanisms for loading, either by hand using the handle 98 or else using the motor 180. Thus, firstly the use of a large number of mechanical drive elements connecting the actuator handle 98 to the pawl 192, such as the links 182, 186 and their hinges 184, 187 makes assembly and operation of the controller complex. Secondly, the use of three different types of pawl 201, 192, and 202 all arranged at the peripheral proximity of the ratchet wheel 188 as anti-return pawls makes assembly and operation of the controller even more complex.

The object of the invention is thus to provide a novel spring type controller provided with a free-wheel coupling device enabling the spring(s) to be released to open or close contacts of high- or medium-voltage electric switchgear without applying rotary torque to a drive motor or crank handle, and that mitigates all or some of the drawbacks of prior art controllers as mentioned above.

A particular object is thus to provide a novel controller of this type that is simple to make and that does not impede the operation of closing or opening contacts of the electric switchgear while releasing the spring(s).

SUMMARY OF THE INVENTION

To do this, the invention provides a spring type controller for a high-voltage or medium-voltage switch, the controller comprising: at least one spring; a first toothed wheel adapted to be driven in rotation with a driving power; a shaft adapted to drive a movable contact of the switch in rotation during an operation of the switch; an arm secured to the shaft and connected to the spring(s); and a free-wheel coupling device coupling the first toothed wheel with the drive shaft in order to transmit the driving power to the spring so as to load the spring, and uncoupling them in order to transmit the torque from the loaded spring to the movable contact but not to the driving power.

According to the invention, the free-wheel coupling device comprises:

- a second toothed wheel having its entire outer periphery provided with teeth permanently meshing with the first toothed wheel and having its entire inner periphery provided with teeth;
- a release element arranged at the peripheral proximity of the second toothed wheel; and
- at least one pawl pivotally mounted on the arm and adapted to be in the following respective positions:
  - meshing with the inner teeth of the second toothed wheel to load the spring until the spring reaches its compression top dead-center by rotation, in a given direction of rotation, of the second toothed wheel and of the arm thus meshing therewith;
  - bearing mutually against the release element once the spring reaches its compression top dead-center, thereby disengaging from the inner teeth by pivoting on the arm in the direction opposite to the direction of rotation of the second toothed wheel, while blocking the arm; and
  - spaced apart from the release lever by action thereon, in order to unblock the arm and allow it to be driven in rotation by the release force from the spring(s) and in the same given direction of rotation, while the second toothed wheel remains stationary.

In other words, the invention consists in suitably incorporating a free-wheel coupling device constituted by a toothed wheel with a pawl meshing therewith while loading the spring to its compression top dead-center, and, once the top dead-center has been reached, in abutting against a release element for disengaging the meshing engagement, thereby making free-wheel operation of the arm possible and thus enabling the drive shaft to be released relative to the toothed wheel during actuation of the release element.

Such a device is particularly simple to implement and its free-wheel operation does not drive any element(s) other than the arm, thereby avoiding any need to accommodate the rotary inertia of parts that would otherwise impede the operation of closing or opening the switch.

The controller of the invention may have a plurality of pawls adapted so that all of them are in the same positions simultaneously.

Advantageously, the release element is a lever that is pivotally mounted to enable it to be moved apart from the pawl. It is thus simple to implement the release element.

The invention also provides high- or medium-voltage electric switchgear provided with at least one switch and including a spring controller as described above.

The switchgear of the invention may be gas insulated, of the dead-tank type, or air insulated, of the live-tank type. It may advantageously be a circuit breaker.

In a variant embodiment, the controller has a single spring for closing the switch.

BRIEF DESCRIPTION OF THE DRAWINGS

Other advantages and advantageous characteristics of the invention appear better on reading the following detailed description made with reference to FIGS. 1 to 4, in which.

DETAILED DESCRIPTION OF PARTICULAR EMBODIMENTS

Figure 1:
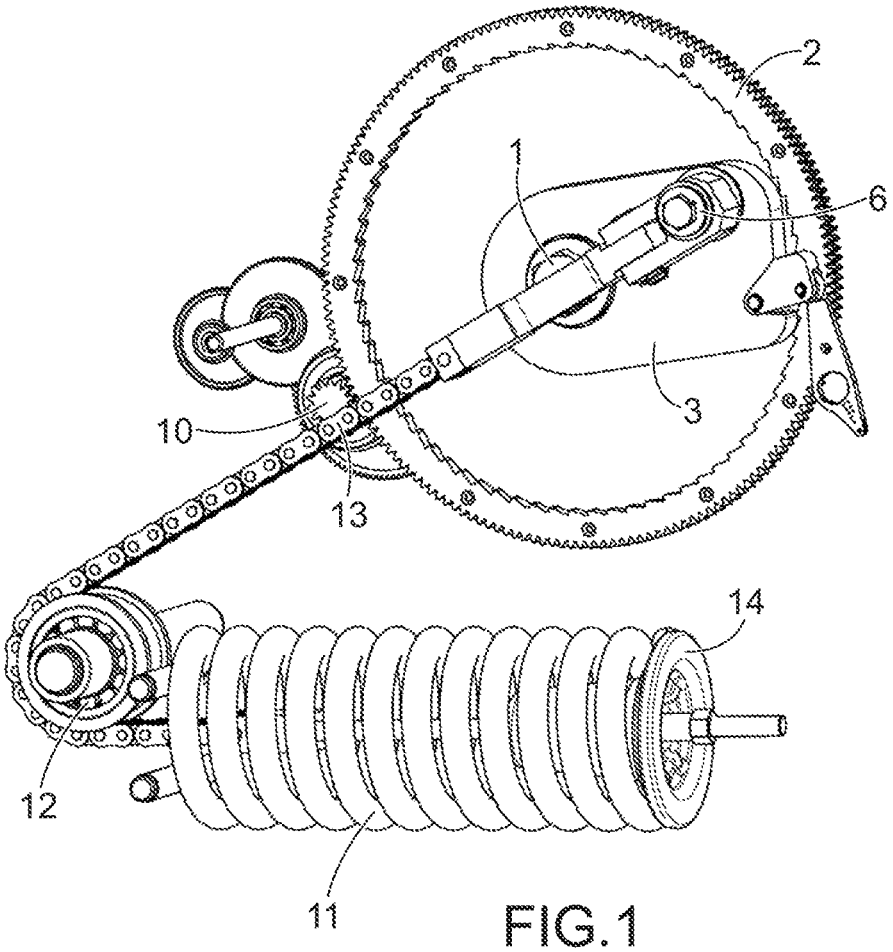
FIG. 1 is a perspective view of a portion of a spring controller of the invention.
Figure 2:
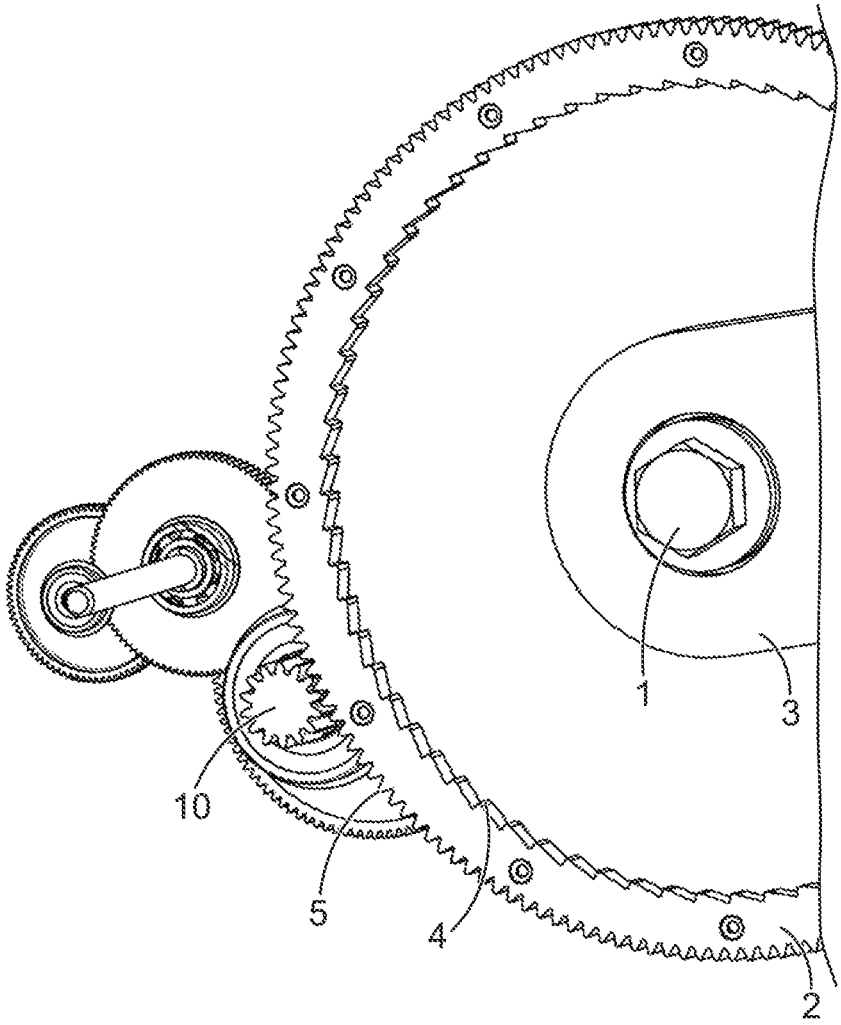
FIG. 2 is a detailed perspective view of the FIG. 1 controller.

FIGS. 1 and 2 are perspective views showing the controller of the invention that operates by storing energy in a spring, and as installed in a high-voltage circuit breaker.

The spring controller of the invention includes a free-wheel mechanical coupling device between a crank handle or a motor (not shown) and the drive shaft 1 for driving a movable contact of the circuit breaker, the free-wheel operation serving to provide mechanical decoupling between the crank handle or the motor and the drive shaft 1 while the closure spring 11 is being released.

More exactly, the controller firstly comprises a first toothed wheel referred to as an outlet wheel 10, that is driven directly or indirectly by a crank handle or by a motor.

This outlet toothed wheel 10 is permanently engaged with straight teeth formed over the entire circumferential outer periphery 5 of a second toothed wheel 2 mounted on a bearing (not shown). In other words, this outlet toothed wheel 10 is permanently coupled to the toothed wheel 2.

The second toothed wheel 2 has teeth 4 of a sloping shape on its inner periphery.

Figure 3A:
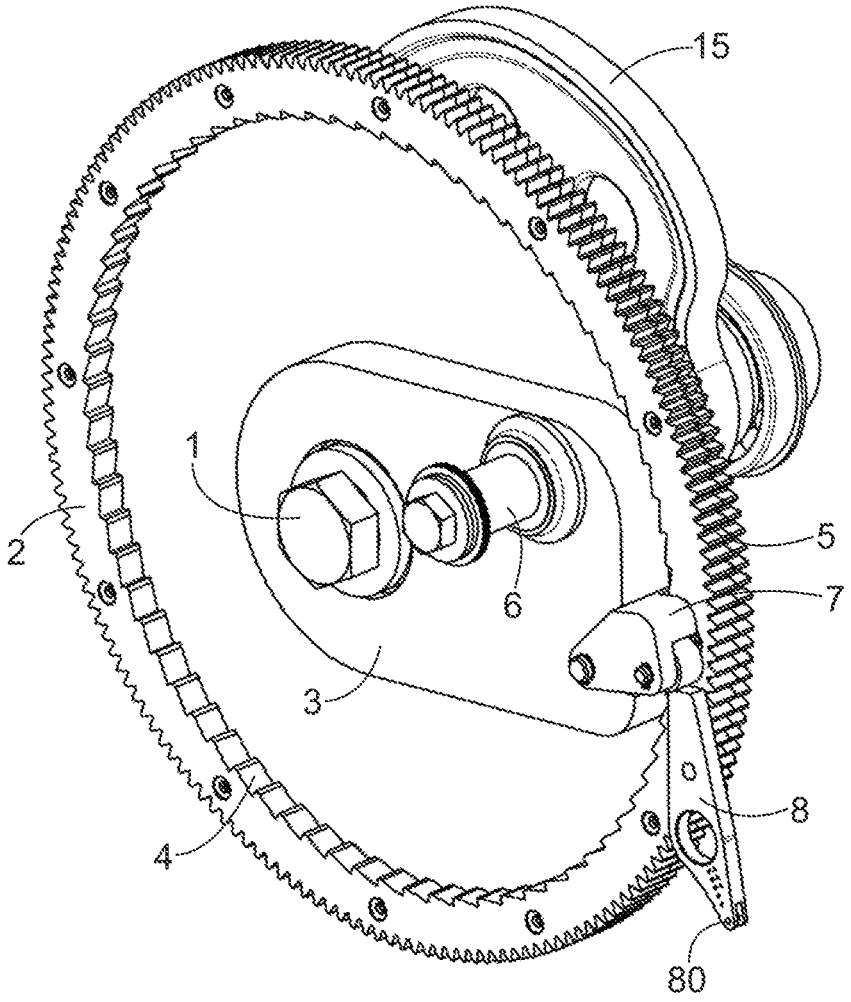
FIGS. 3A and 3B are likewise detailed perspective views of the FIG. 1 controller shown respectively in the fully-loaded state of the closure spring of the controller and at the beginning of an operation of releasing the closure spring.

Inside the inner periphery of the teeth of sloping shape, there is arranged an arm 3 that is secured to the rotary drive shaft 1 of the movable contact of the circuit breaker via a cam 12 that is shown in greater detail in FIG. 3A. As shown, the arm 3 is fastened to the end of the shaft 1 by screw fastening. Naturally, any other fastening technique may be envisaged. Thus, the drive shaft 1 and the arm 3 are adapted to rotate simultaneously.

As can be seen better in FIG. 1, the arm 3 has a pivot 6 fastened thereto, which pivot is itself connected to a helical compression spring 11 via a transmission system comprising a chain 13, a deflector pulley, and a rod 14 bearing against the free end of the closure spring 11.

A pawl 7 is mounted to pivot about a pin 9 at the free end of the arm 3. When it is in its non-pivoted position (upwards in the figures), the pawl 7 is in meshing engagement with the teeth 4 on the inner periphery of the second toothed wheel 2: thus, in this non-pivoted position, there is mechanical coupling between the wheel 2 and the arm 3 and thus the drive shaft to which it is fastened. When it is in its upwardly-pivoted position, the pawl 7 is not in meshing engagement with the teeth 4: thus, in this pivoted position, there is mechanical decoupling between the toothed wheel 2 and the arm 3. The pawl 7 is moved from its non-pivoted position to its upwardly-pivoted position during rotation of the arm 3 coupled to the toothed wheel 2 by the pawl coming into peripheral abutment against a lever 8, referred to as a "trip" lever. The trip lever 8 is a lever that pivots about a pin 80 and that is located in the proximity of the toothed wheel 2.

It is specified at this point that because of the relative arrangement between the various elements of the closure spring, of the transmission system 12, 13, 14, and of the arm 3 with its pivot, as shown, the upwardly-pivoted position of the pawl 7 as reached by coming into peripheral abutment against the lever 8 (FIGS. 1, 3A, and 3B) corresponds to the top dead-center of the closure spring 11, i.e. to its maximally compressed state.

The closure spring controller 11 of the invention also includes an anti-return device (not shown) having the function of preventing either directly the outlet toothed wheel 10 from rotating in the clockwise direction, or directly the toothed wheel 2 from rotating in the counterclockwise direction in the face view of the figures. The function of this anti-return device is explained below with reference to the operation of the controller. Such an anti-return device, which may be purely mechanical, may easily be arranged within the controller by the person skilled in the art without reducing the simplicity thereof.

The operation of the spring controller of the invention is described below.

Figure 4:
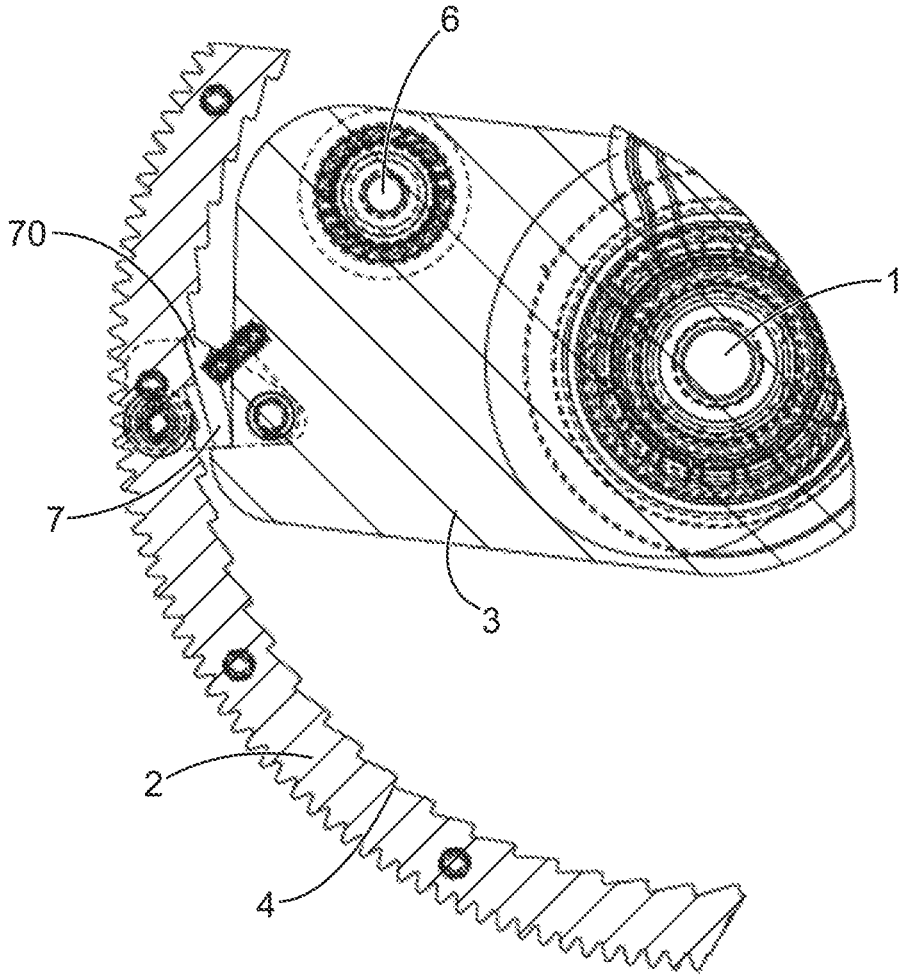
FIG. 4 is a cross-section view through the ratchet free-wheel coupling device of the invention.

When it is desired to load the closure spring 11, the outlet toothed wheel 10 is driven by a crank handle or a motor in the counterclockwise direction in the face view of the figures. The second toothed wheel 2 is then driven in rotation in the clockwise direction. The pawl 7 is then engaged with the teeth 4 of the inner periphery of the toothed wheel, and the arm 3 is thus coupled in rotation with the toothed wheel 2 to rotate in this clockwise direction: FIG. 4 shows more particularly the coupling between the coupling portion proper 70 of the pawl 7 and the complementary teeth 4 of sloping shape. This engagement between the pawl 7 and the toothed wheel 2 continues until the pawl 7 comes into peripheral abutment against the trip lever 8. In this position, the closure spring 11 is thus almost completely fully loaded. Full loading of the closure spring 11 (reaching top dead-center) is achieved when the pawl 7 reaches its upwardly-pivoted position by bearing against the lever 8. In this upwardly-pivoted position, the pawl 7 is no longer engaged with the teeth 4, i.e. it is disengaged therefrom: the arm 3 is thus decoupled from the toothed wheel 2. This position in which the pawl 7 is disengaged thus enables the toothed wheel 2 to continue to turn without changing the position of the arm 3. As a result, the motor or the crank handle driving the toothed wheel 2 via the outlet toothed wheel 10 may slow down progressively. This avoids imparting any damage to a mechanical element as a result of the motor or the crank handle stopping suddenly. In other words, an operator may continue to turn the handle or the motor may continue to run without giving rise to damage.

Furthermore, because of the anti-return device, even if an operator turning the outlet toothed wheel 10 via the crank handle while loading the spring 11 should let go of the handle in untimely manner, the arm 3 cannot drive the toothed wheel 2 in the counterclockwise direction. In other words, the operator does not run the risk of being injured by the crank handle, since it cannot be driven in rotation by the toothed wheels 10, 2 that are blocked by the anti-return device.

Figure 3B:
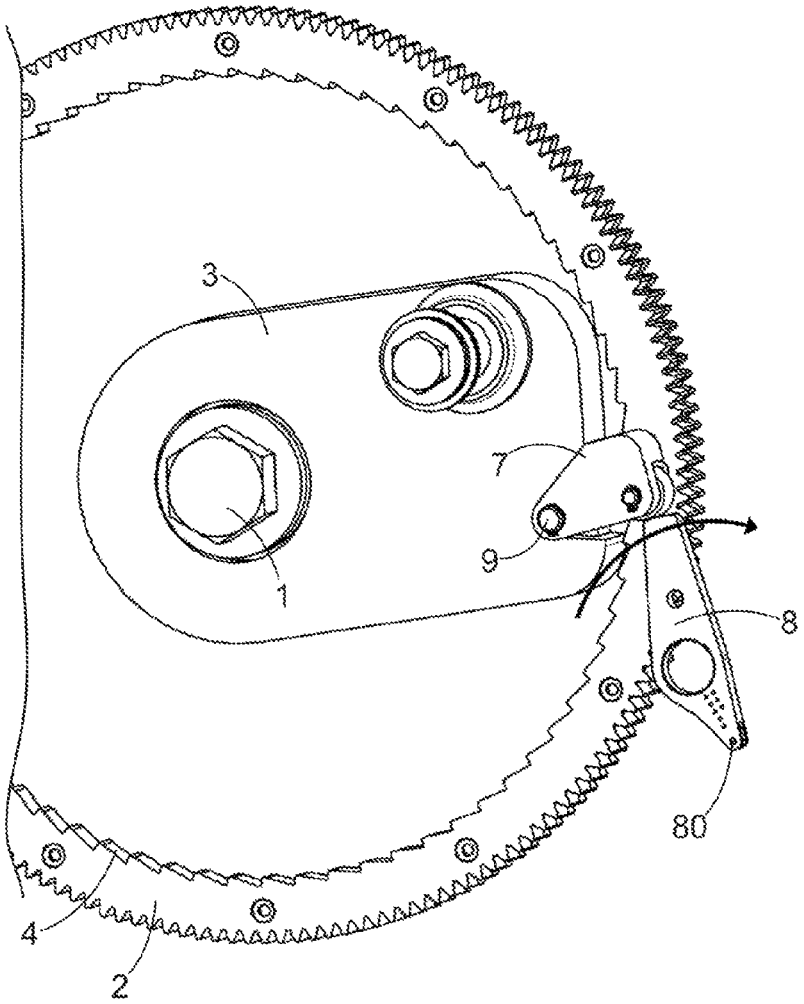

When the circuit breaker is to be closed in order to interrupt a current, the trip lever 8 is pivoted in the clockwise direction as shown better by the arrow in FIG. 3B. Once the trip lever 8 no longer bears against the pawl 7, the arm 3 is no longer blocked against rotating in the clockwise direction in the face view of the figures. Since the pawl 7 is also no longer engaged with the teeth 4 on the inner periphery of the toothed wheel 2, the arm 3 and the switch drive shaft 1 to which it is fastened then rotate in the clockwise direction under the traction force from the chain 13 generated by the force of the closure spring 11 releasing. In other words, they operate in a free-wheel configuration relative to the mechanically decoupled toothed wheel 2, which therefore remains stationary in rotation. The drive shaft 1 thus drives the movable contact of the circuit breaker by means of the cam 15.

The closure spring controller 11 fitted with the free-wheel coupling device including the pawl 7 is simple to implement and does not include any rotary component presenting inertia that would prejudice the closure operation of the circuit breaker when the spring is released.

Other improvements or variants may be provided without thereby going beyond the ambit of the invention.

Thus, for example, although the controller is shown as having only a single pawl 7, it is possible to envisage arranging a plurality of pawls engaged with the teeth on an inner periphery of the toothed wheel: in such a configuration, it will naturally be understood that all of the pawls are respectively engaged and disengaged with the teeth simultaneously. In other words, the pivoting for enabling them to reach their position disengaged from the teeth is obtained simultaneously for all of the pawls.

Furthermore, although shown with a transmission system (deflector pulley 12, chain 13), it is also possible to envisage a direct connection between one end of a spring and a pivot fastened on the arm, i.e. without making use of a chain and a pulley.

Finally, although shown with only one closure spring, the controller of the invention may equally well incorporate a plurality of springs that are to be compressed.

Likewise, although shown in the form of a helical spring, it is possible to use one or more spiral springs.

The person skilled in the art will select the type of spring and the number of springs depending on the torque needed for driving the movable contact(s) of the switchgear and on the space available within the controller.

What is claimed is:

1. A spring type controller for a high-voltage or medium-voltage switch, the controller comprising: at least one spring; a first toothed wheel adapted to be driven in rotation with a driving power; a shaft adapted to drive a movable contact of the switch in rotation during an operation of the switch; an arm secured to the shaft and connected to the at least one spring; and a free-wheel coupling device coupling the first toothed wheel with the shaft in order to transmit the driving power to the at least one spring so as to load the at least one spring, and uncoupling them in order to transmit torque from the loaded at least one spring to the movable contact but not to the driving power; the free-wheel coupling device comprising:

a second toothed wheel having an outer periphery and an inner periphery, the entire outer periphery being provided with teeth permanently meshing with the first toothed wheel and the entire inner periphery being provided with teeth;

a release element arranged proximate to the outer and inner peripheries of the second toothed wheel; and at least one pawl pivotally mounted on the arm and adapted to be in the following respective positions:

meshing with the inner teeth of the second toothed wheel to load the at least one spring until the at least one spring reaches a compression top dead-center by rotation, in a given direction of rotation, of the second toothed wheel and of the arm thus meshing therewith;

bearing mutually against the release element once the at least one spring reaches the compression top dead-center, thereby disengaging from the inner teeth by pivoting on the arm in a direction opposite to a direction of rotation of the second toothed wheel, while blocking the arm; and spaced apart from the release lever by action thereon, in order to unblock the arm and allow it to be driven in rotation by the release force from the at least one spring and in the same given direction of rotation, while the second toothed wheel remains stationary.

2. A spring controller according to claim 1, having a plurality of pawls adapted so that all of them are in the same positions simultaneously.

3. A spring controller according to claim 1, the release element being a lever that is pivotally mounted to enable it to be moved apart from the pawl.

4. High- or medium-voltage electric switchgear provided with at least one switch and including a spring controller according to claim 1.

5. Switchgear according to claim 4, being a dead-tank type gas insulated switchgear.

6. Switchgear according to claim 4, being a live-tank type air insulated switchgear.

7. Switchgear according to claim 4, the switch being a circuit breaker.

8. Switchgear according to claim 4, the controller having a single switch closure spring.

* * * * *